United States Patent [19]

Bell, Sr.

[11] 4,090,465

[45] May 23, 1978

[54] TRAFFIC CONTROL DIRECTOR

[76] Inventor: George G. Bell, Sr., P.O. Box 1633, Jackson, Miss. 49205

[21] Appl. No.: 752,831

[22] Filed: Dec. 21, 1976

[51] Int. Cl.[2] ..... E01F 9/01; G09F 7/18

[52] U.S. Cl. ..... 116/63 R; 40/608; 40/612

[58] Field of Search ..... 116/63 R, 63 P; 404/10, 404/11; 40/125 H, 125 N, 145 A; 85/32.1

[56] References Cited

U.S. PATENT DOCUMENTS

| | | | |
|---|---|---|---|
| 919,913 | 4/1909 | Miller | 85/32.1 X |
| 1,726,817 | 9/1929 | Franklin | 116/63 P |
| 2,121,961 | 6/1938 | Gill | 404/10 |
| 2,590,506 | 3/1952 | Carter | 116/63 P X |
| 3,016,035 | 1/1962 | Asbury | 116/63 P |
| 3,241,516 | 3/1966 | Hopkins | 116/173 |
| 3,478,715 | 11/1969 | Asbury | 404/10 X |

*Primary Examiner*—Daniel M. Yasich

*Attorney, Agent, or Firm*—Clarence A. O'Brien; Harvey B. Jacobson

[57] ABSTRACT

A traffic control director having a base on which is mounted a flexible standard disposed extending vertically for supporting a sign above the base. Recesses provided on the base receive the standard when same is bent downwardly from its vertical position toward the base so as to prevent damage to the standard.

9 Claims, 12 Drawing Figures

Fig. 1
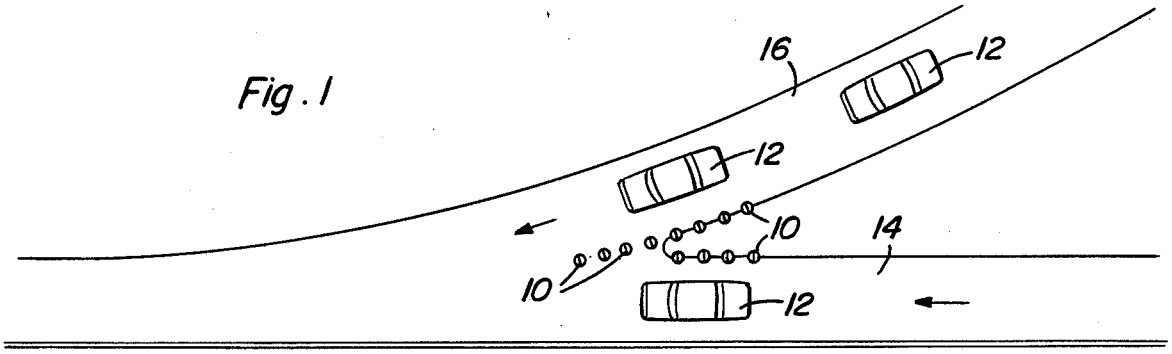
Fig. 2
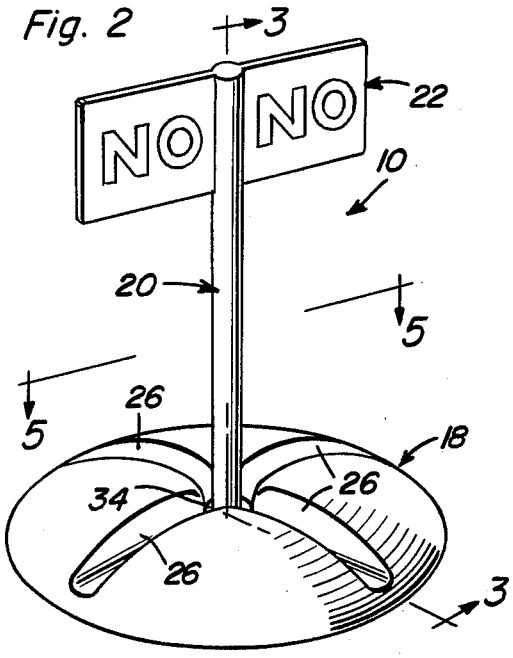
Fig. 5
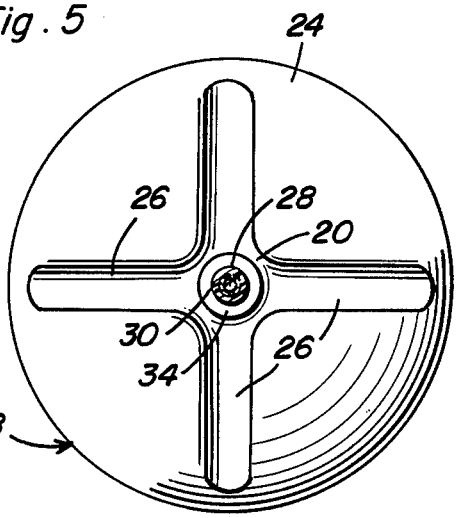
Fig. 3
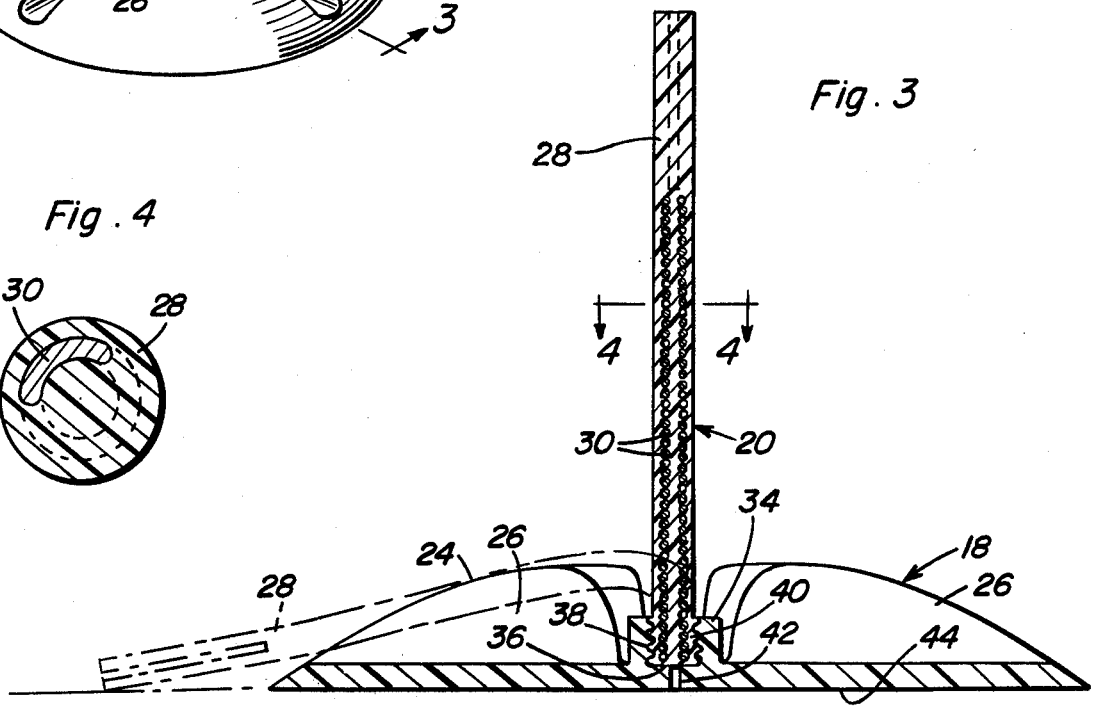
Fig. 4

TRAFFIC CONTROL DIRECTOR

BACKGROUND OF THE INVENTION

1. Field of the Invention

This invention relates generally to a visual device which will deter a vehicle from prematurely crossing into an on-going line of through traffic from a merging lane of traffic, so as to permit the flow of traffic to smoothly merge, as desired, and particularly to a traffic control device which will resist wear and destruction under traffic control conditions.

2. Description of the Prior Art

A problem encountered with the use of limited access roads is the merging of vehicles from an on-ramp into a line of traffic on the road. As can be readily observed on such roads, or highways, the oncoming vehicles frequently cross into the adjacent through traffic lane of the road before the on-ramp itself merges into the lane of the road in question. While it would be advantageous to position barriers of a suitable nature along the on-ramp and highway where same are separated, but are physically joined together in such a manner that vehicles can pass from one to the other, the wear and damage incurred by such control devices makes the use of same impractical.

It is generally known to provide traffic directing devices which employ flexible shafts so that the shaft will bend when struck by a vehicle, and the like. Examples of such devices can be found in U.S. Pat. Nos: 1,267,021, issued May 21, 1918, to J. A. Watts; U.S. Pat. No. 1,487,635, issued Mar. 18, 1924, to J. A. Watts; U.S. Pat. No. 1,599,066, issued Sept. 7, 1926, to S. W. Rushmore; and U.S. Pat. No. 2,165,704, issued July 11, 1939, to J. B. Hood. In particular, U.S. Pat. No. 2,165,704 discloses a sign which has a resilient standard formed by a spring surrounded by a resilient covering. A screw threaded sleeve is provided on the standard which permits the standard or post to be removably mounted on a suitable base.

SUMMARY OF THE INVENTION

It is an object of the present invention to provide a merging traffic control device in the form of a visual device that will deter a vehicle from prematurely crossing into an on-going lane through traffic from a merging lane of a limited access highway.

It is another object of the present invention to provide a merging traffic control device constructed in such a manner as to permit the device to be struck by a motor vehicle, and the like, without the device being damaged.

It is yet another object of the present invention to provide a merging traffic control device which can be struck by motor vehicles without damage either to the device or to the vehicle, and which will be restored to normal operating position immediately following impact by a motor vehicle, and the like.

These and other objects are achieved according to the present invention by providing a traffic control director having: a base; a flexible column disposed extending vertically from the base for normally supporting a sign or other traffic directing elements above the base; and a recess provided on the base for receiving the column when same is bent downwardly toward the base.

The base of the device advantageously includes an upwardly facing surface, with the recess being a groove arranged extending away from the column mounted on the base for receiving the column when same is bent down against the upper surface of the base. Preferably, there are a plurality of such grooves provided in the upper surface of the base, with each of the grooves being arranged extending away from the column and diverging from one another.

The column itself is advantageously in the form of a flexible upright standard comprising a longitudinally extending rod constructed from a resilient material and having imbedded therein a coiled spring or suitable flexible material arranged for causing the standard to be restored to an upright position following deflection of the standard toward the base of the device.

The device also includes an attachment arrangement disposed for removably mounting the standard on the base of the device. This attachment arrangement includes, according to one preferred embodiment of the invention, a hub arranged extending upwardly from the base, a socket provided in the hub, internal screw threads provided in the socket, and external screw threads provided on the standard for engaging with the internal screw threads provided in the socket and retaining the standard on the base. According to a second embodiment of the invention, the attachment arrangement includes a hub extending upwardly from the base, a bore provided in the hub, the bore terminating in a ledge forming an internal cavity within the hub, a flange provided on the standard and disposed removably engaged in the cavity, internal screw threads provided in the bore, and a sleeve arranged in the bore over the standard and provided with external screw threads engaged with the internal screw threads provided in the bore for retaining the standard on the base of the device. The flange is provided with one or more slits arranged for aiding in removing and inserting the flange in the cavity, and for placing the sleeve on the standard.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a schematic, plan view showing traffic control directors according to the present invention being used to control merging traffic on a limited access highway, and the like.

FIG. 2 is a perspective view showing a first embodiment of a traffic control director according to the present invention.

FIG. 3 is an enlarged, sectional view taken generally along the line 3—3 of FIG. 2.

FIG. 4 is an enlarged, sectional view taken generally along the line 4—4 of FIG. 3.

FIG. 5 is a sectional view taken generally along the line 5—5 of FIG. 2.

DESCRIPTION OF THE PREFERRED EMBODIMENTS

Figure 6:
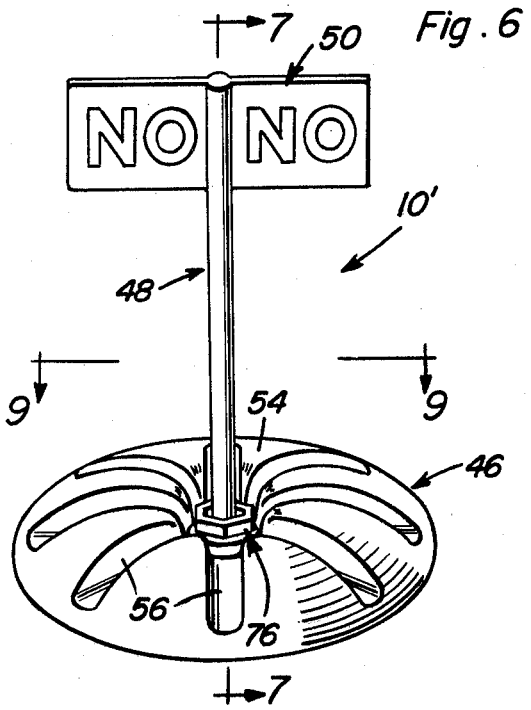
FIG. 6 is a perspective view, similar to FIG. 2, but showing a second preferred embodiment of a merging traffic control director, according to the present invention.

Referring now more particularly to FIG. 1 of the drawings, a plurality of merging traffic control directors 10 according to the present invention are shown controlling the merger of vehicles 12 onto a highway 14 from an on-ramp 16. As can be seen from FIG. 1, the directors prevent the vehicles 12 moving up ramp 16 from passing onto the adjacent lane of highway 14 until a predetermined point of merger is reached.

While the directors 10 are disposed in areas where vehicles are to be restricted from travel, it will be appreciated that occasionally a vehicle will pass into the area occupied by directors 12 and strike same possibly causing damage.

Referring now more particularly to FIGS. 2 through 5 of the drawings, a director 10 according to the present invention includes a base 18 from which extends vertically upwardly a flexible column in the form a standard 20. The standard 20 supports a suitable sign 22 above the base 18. While sign 22 is shown as being a generally rectangular element containing suitable instructions to motorists, it will be appreciated that sign 22 can be a flag, an element in the shape of an arrow, an element having impregnated reflector pigments provided thereon, or any other suitable instructional element as conventionally used in motor vehicle traffic control. A recess arrangement is provided on base 18 for receiving standard 20 when same is bent downwardly toward base 18. This arrangement, which helps protect standard 20 from damage when same is struck by a vehicle 12, includes an upwardly facing surface 24 provided on base 18 and having formed therein a plurality of grooves 26 arranged extending away from standard 20 for receiving standard 20 when same is deflected against upper surface 24 of base 18. In this manner, the grooves 26 diverge from one another as they extend away from the point of attachment from standard 20 to base 18.

The flexible upright standard 20 which forms the column advantageously comprises a longitudinally extending rod 28 constructed from a resilient material of a conventional nature, such as a suitable polymeric resin or a natural or synthetic rubber, in which is imbedded a coiled spring 30. The latter causes standard 20 to be restored to a substantially upright position following deflection of standard 20 toward base 18, and to retain the substantially upright position until such time as a sufficient force is applied to standard 20, or sign 22 to cause standard 20 to be deflected back downwardly against upper surface 24 of base 18.

The director 10 according to the invention also includes an attachment arrangement 32 for removably mounting standard 20 on base 18. This arrangement 32 includes a hub 34 extending upwardly from the surface 24 of base 18, a socket 36 provided in hub 34, internal screw threads provided in socket 36, and external screw threads 40 provided on standard 20 adjacent the lower end thereof for engaging with the internal screw threads 38 provided in socket 36 in order to removably retain the standard 20 on the base 18.

An aperture 42 is provided centrally within base 18 so as to extend between the upper surface 24 and a planar lower surface 44 of base 18 and permit rainwater, and the like, to be drained from the bottom of base 18.

Figure 9:
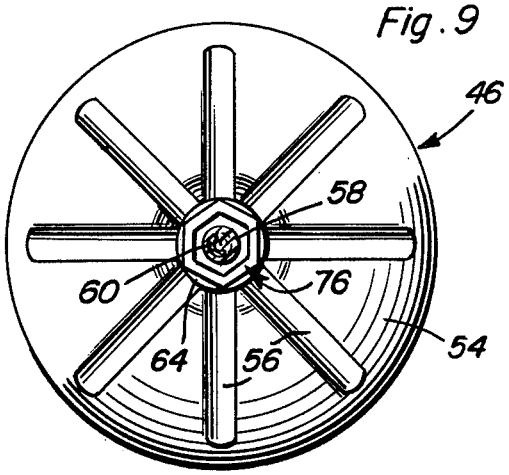
FIG. 9 is a sectional view taken generally along the line 9—9 of FIG. 6.
Figure 7:
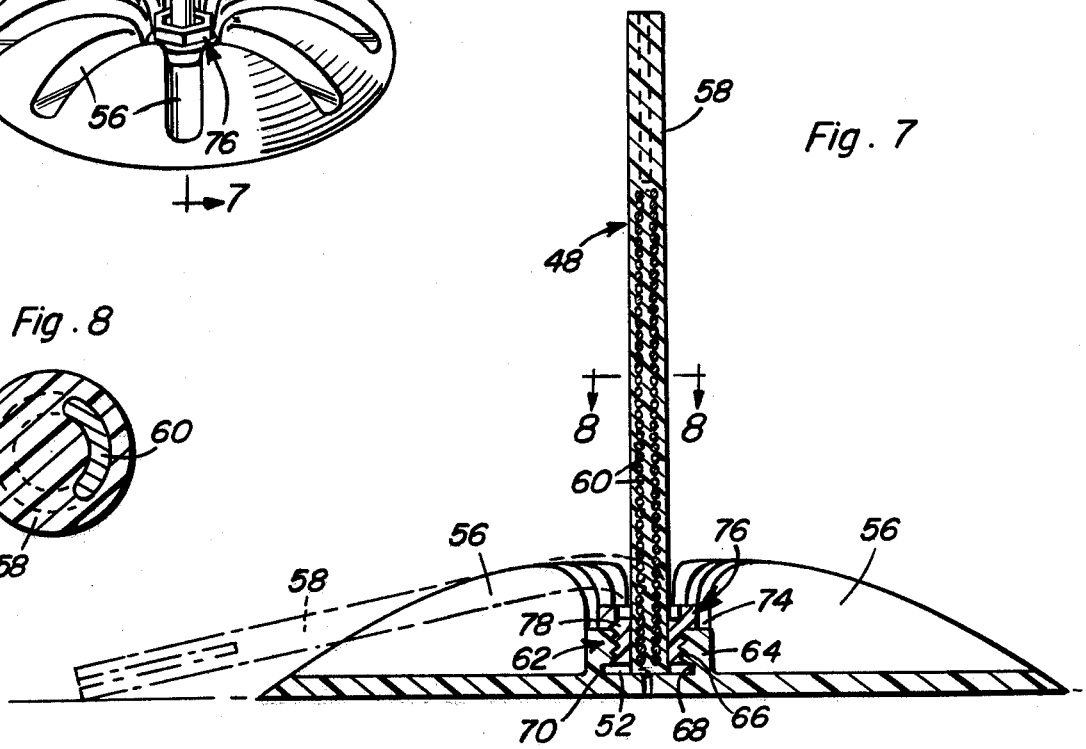
FIG. 7 is an enlarged, sectional view taken generally along the line 7—7 of FIG. 6.
Figure 8:
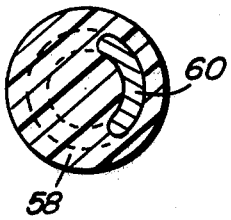
FIG. 8 is an enlarged, sectional view taken generally along the line 8—8 of FIG. 7.
Figure 10:
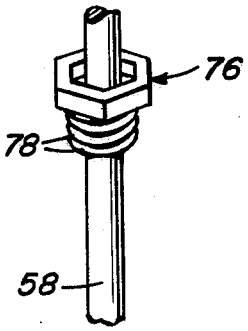
FIG. 10 is an exploded, fragmentary, perspective view showing the relationships between an element of the attachment arrangement of the embodiment of FIGS. 6 through 9 with respect to the standard employed with such embodiment.
Figure 11:
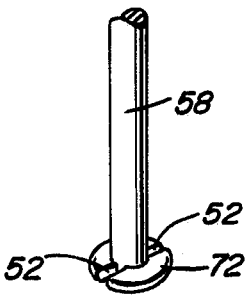
FIG. 11 is a fragmentary, perspective view showing the lower end portion of a standard used with the embodiment of FIGS. 6 through 9.
Figure 12:
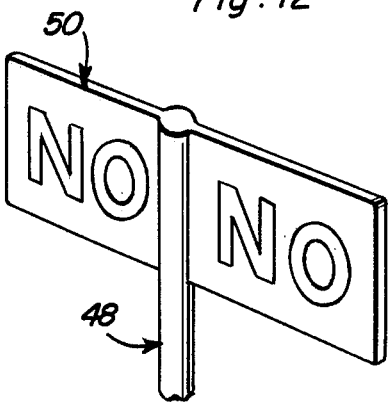
FIG. 12 is a fragmentary, perspective view showing the manner of attachment of a sign to the upper end of a standard used with the embodiment of the invention according to FIGS. 6 through 9.

FIGS. 6 through 12 of the drawings show a second embodiment designated 10′ of a director according to the present invention. This director 10′ includes a base 46 removably mounted on which is a standard 48 similar to standard 20. Base 46 is essentially the same as base 18. A suitable sign 50 is integrally formed at the uppermost end of standard 48, while the upwardly directed surface 54 of base 46 is provided with a plurality of grooves 56 similar to grooves 26.

Standard 48 is similar to standard 20 inasmuch as it is constructed from a flexible rod 58 in which is imbedded a spring 60. Standard 48, however, includes an attachment arrangement 62 which is different from arrangement 32 of standard 20.

Attachment arrangement 62 includes a hub 64 arranged extending upwardly from the central portion of the upper surface 54 of base 46. A bore 66 is provided in hub 64, with this bore 66 terminating in a ledge 68 forming an internal cavity 70 within hub 64. A flange 72 having one or more slits 52 is provided on the lower end of standard 48, and is disposed removably engaged in cavity 70. Internal screw threads are provided in bore 66, while a sleeve 76 is arranged in the bore 66 and over the standard 48 (see FIG. 10) and is provided with external screw threads 78 which engage with threads 74 in order to retain sleeve 76 within bore 66 and cause flange 72 to be firmly held within cavity 70. Slits 52 afford flange 72 sufficient flexibility to allow base 46 to be substantially rigid and still permit flange 72 to be inserted into and removed from cavity 70, as well as permit sleeve 76 to be slidably disposed on standard 48 by forcing the sleeve over flange 72.

As can be readily understood from the above description and from the drawings, a traffic control director according to the present invention provides a rugged and reliable device which is virtually undamageable by impact from motor vehicles, and the like, for use in merging lanes and similar roadways for controlling the flow of vehicle traffic along a highway.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A traffic control director, comprising, in combination:

(a) a base having a peripheral edge;

(b) flexible column means disposed extending substantially vertically from the base for normally supporting a sign above the base;

(c) recess means provided on the base for receiving a portion of the column means normally spaced from the base and recess means when the column means is deflected downwardly toward the base by impact from a passing vehicle, the base including an upwardly facing surface, and the recess means including at least one groove arranged extending away from the column means for receiving the column means, the groove being provided in the upwardly facing the surface of the base, the at least one groove being a plurality of grooves provided in the upwardly facing surface of the base, each of the grooves being arranged extending away from the column means and diverging from one another, the column means including a flexible upright standard, the standard comprising a longitudinally extending rod constructed from a resilient material, and a coiled spring imbedded in the rod for causing the standard to be restored to an upright position following deflection of the standard toward the base each of the grooves ending near the peripheral edge of the base so that one of the grooves will receive the column means when deflected downwardly in a direction toward said one of the grooves by impact by a passing vehicle; and (d) attachment means for removably mounting the standard on the base, the attachment means including a hub extending upwardly from the base, a socket provided in the hub, internal screw threads provided in the socket, and external screw threads provided on the standard for engaging with the screw threads in the socket.

2. A traffic control director, comprising, in combination:

(a) a base;

(b) flexible column means disposed extending substantially vertically from the base for normally supporting a sign above the base;

(c) recess means provided on the base for receiving the column means when same is deflected downwardly toward the base by impact from a passing vehicle, the column means including a flexible upright standard, the standard comprising a longitudinally extending rod constructed from a resilient material, and a coiled spring imbedded in the rod for causing the standard to be restored to an upright position following deflection of the standard toward the base; and (d) attachment means for removably mounting the standard on the base, the attachment means including a hub arranged extending upwardly from the base, a bore provided in the hub, the bore terminating in the ledge forming an internal cavity within the hub, a flange provided on the standard and disposed removably engaged in the cavity, internal screw threads provided in the bore, and a sleeve arranged in the bore and disposed over the standard, the sleeve being provided with external screw threads engaged with internal screw threads for removably mounting the standard on the base, the flange being provided with at least one slit arranged for affording the flange sufficient flexibility for assembly on the attachment means.

3. A traffic control director, comprising, in combination:

(a) a base;

(b) flexible column means disposed extending substantially vertically from the base for normally supporting a sign above the base;

(c) recess means provided on the base for receiving a portion of the column means normally spaced from the base and recess means when the column means is deflected downwardly toward the base by impact from a passing vehicle; and (d) attachment means for removably mounting the column means on the base, the attachment means including a hub arranged extending upwardly from the base, a bore provided in the hub, the bore terminating in a ledge forming an internal cavity within the hub, a flange provided on the standard and disposed removably engaged in the cavity, internal screw threads provided in the bore, and a sleeve arranged in the bore and disposed over the column means, the sleeve being provided with external screw threads engaged with the internal screw threads of the hub for removably mounting the column means on the base.

4. A structure as defined in claim 3, wherein the base includes an upwardly facing surface, and the recess means includes at least one groove arranged extending away from the column means for receiving the column means, the groove being provided in the upwardly facing surface of the base.

5. A structure as defined in claim 4, wherein the at least one groove is a plurality of grooves provided in the upwardly facing surface of the base, each of the grooves being arranged extending away from the column means and diverging from one another.

6. A structure as defined in claim 5, wherein the column means includes a flexible upright standard.

7. A structure as defined in claim 2, wherein the standard comprises a longitudinally extending rod constructed from a resilient material, and a coiled spring imbedded in the rod for causing the standard to be restored to an upright position following deflection of the standard toward the base.

8. A structure as defined in claim 1, wherein the column means includes a flexible upright standard.

9. A structure as defined in claim 8, wherein the standard comprises a longitudinally extending rod constructed from a resilient material, and a coiled spring imbedded in the rod for causing the standard to be restored to an upright position following deflection of the standard toward the base.

* * * * *